US008075368B2

(12) United States Patent
Puyaubreau

(10) Patent No.: US 8,075,368 B2
(45) Date of Patent: Dec. 13, 2011

(54) BRASSIERE FOR PRACTICING SPORTS

(75) Inventor: Céline Puyaubreau, Marseilles (FR)

(73) Assignee: Decathlon, Villeneuve d'Ascq (FR)

( * ) Notice: Subject to any disclaimer, the term of this patent is extended or adjusted under 35 U.S.C. 154(b) by 454 days.

(21) Appl. No.: 12/087,788

(22) PCT Filed: Jan. 16, 2007

(86) PCT No.: PCT/FR2007/050655

§ 371 (c)(1),
(2), (4) Date: Oct. 21, 2008

(87) PCT Pub. No.: WO2007/080355

PCT Pub. Date: Jul. 19, 2007

(65) Prior Publication Data

US 2009/0081924 A1 Mar. 26, 2009

(30) Foreign Application Priority Data

Jan. 16, 2006 (FR) ..... 06 00378

(51) Int. Cl.
*A41C 3/00* (2006.01)

(52) U.S. Cl. ..... 450/65; 450/66; 450/72

(58) Field of Classification Search ..... 450/30, 450/65, 66, 70, 72, 73, 75, 76, 74; 66/176, 66/177, 172 E, 171, 170, 153
See application file for complete search history.

(56) References Cited

U.S. PATENT DOCUMENTS

| | | | | |
|---|---|---|---|---|
| 4,655,224 | A | 4/1987 | Stern | |
| 5,873,767 | A | 2/1999 | Pickett | |
| 6,287,168 | B1 | 9/2001 | Rabinowicz | |
| 6,685,534 | B2 * | 2/2004 | Mitchell et al. | 450/74 |
| 6,685,535 | B2 * | 2/2004 | Mitchell | 450/75 |
| 6,779,367 | B2 * | 8/2004 | Mitchell et al. | 66/176 |
| 6,790,122 | B2 * | 9/2004 | Mitchell et al. | 450/66 |
| 6,899,591 | B2 * | 5/2005 | Mitchell | 450/65 |
| 6,918,812 | B2 * | 7/2005 | Giese | 450/65 |
| 7,163,432 | B2 * | 1/2007 | Mitchell et al. | 450/65 |
| 7,169,011 | B2 * | 1/2007 | Mitchell et al. | 450/66 |
| 2005/0266770 | A1 | 12/2005 | Henricksen | |

FOREIGN PATENT DOCUMENTS

| | | |
|---|---|---|
| EP | 1 537 794 A2 | 6/2005 |
| FR | 2 864 429 A1 | 7/2005 |
| GB | 845 173 A | 8/1960 |

* cited by examiner

*Primary Examiner* — Gloria Hale
(74) *Attorney, Agent, or Firm* — Kenyon & Kenyon LLP

(57) ABSTRACT

A brassiere includes two cups for the breasts, a contact strip positioned under the cups that encircles an area below the bust, two shoulder straps connected to, and extending upwardly from, the cups, and connected to a rear panel, a middle panel positioned between the two cups, and side panels extending from the cups to the rear panel. Inner layers of the cups having a vertical elasticity of at least 60% with respect to a total vertical height of the cups, and at least 15% of the total area of the inner layers configured to contact the skin. The middle panel has a horizontal elasticity of at least 20%. The adherence capacity of the inner layers of the cups can be increased by a silicone material that has a high friction coefficient.

11 Claims, 2 Drawing Sheets

BRASSIERE FOR PRACTICING SPORTS

This is a 371 national phase application of PCT/FR2007/050655 filed 16 Jan. 2007, claiming priority to French patent application 06/00378 filed 16 Jan. 2006, the contents of which are incorporated herein by reference.

FIELD OF THE INVENTION

The present invention relates to the field of feminine undergarments, and particularly those intended for women when practicing a sport.

BACKGROUND OF THE INVENTION

The practice of a sport calls for movements of the body that, necessarily, give rise to a relative movement of the breast, which can prove to be a hindrance or even a major drawback. This is particularly the case when it involves a sport during which the body is required to repeat a movement, especially when running.

The manufacturers of feminine undergarments have sought to remedy this difficulty by proposing undergarments that provide tighter support for the breast, using a stronger type of strengthening element for example, or by protecting the breasts in heat-moulded cups. However the level of comfort achieved by these techniques still leaves a lot to be desired.

SUMMARY OF THE INVENTION

The aim of the present invention is to propose a feminine undergarment that is conventional in make-up, meaning in which the cups are not heat-moulded, and which nevertheless provide effective and comfortable support for the breasts during the practice of a sport.

It concerns a feminine undergarment that, in a manner that is known from document U.S. Pat. No. 4,655,224, has two cups for the breasts, with an inner wall and possibly an outer wall, a contact strip positioned under the cups and intended to circle the bust, two support elements attached firstly to the cups in the upward extension of the latter and secondly to a rear panel, with a middle panel extending between the two cups, and side panels extending from the cups to the rear panel.

In a manner that is characteristic, according to the present invention:

a) In the vertical direction, the inner wall of the cups has an elasticity of 60% at most, and at least 15% of the surface of the said wall has an ability to adhere to the skin, and b) the middle panel has a horizontal elasticity of at least 20%, preferably of the order of 60% to 80%.

In the present document, there is mention of cups which, in general, indicate the zone of the undergarment that is intended to accommodate the breast, where this zone has a three-dimensional configuration and/or is made from a material that is suitable to fit closely to and support the breast.

Each side panel preferably extends partially under a cup and at least up to two-thirds outside cup and, in the part that extends under the bottom part of the cup, has a reduced vertical elasticity of 60% at most.

It is the combination of these different characteristics that can be used to achieve a substantial improvement in the support and comfort afforded to the breasts during the practice of a sport. With reference to adherence capacity, there is naturally no question of causing the inner wall of the cup to adhere to the skin, but simply making use in particular of a high friction coefficient with the skin in order to achieve a non-slip effect between the inner wall and the skin. This non-slip effect, in association with the reduced elasticity in the vertical direction of the material constituting the inner wall of the cup, and preferably that of the part of the side panel located under the bottom part of the corresponding cup, impedes the vertical movement of the breast, both upwards and downwards, during the practice of sport. The presence of the middle panel with a good horizontal elasticity does not hinder the opening of the thoracic cage and facilitates breathing.

According to a variant embodiment, the adherence capacity of the inner wall of the cups is due to the presence of a material that has a high friction coefficient with the skin, in particular of the silicone type. This material comes in the form of either studs, wavelets or a complete covering deposited onto the panel in which the inner wall of the cup is formed, or in the form of threads inserted during the manufacture of the said panel.

In the field of feminine undergarment, one is already familiar with the use of silicone, including use for its adherence capacity, in particular in the form of non-slip inserts in socks, stockings and tights.

According to an embodiment of the aforementioned variant, in which the material with a high friction coefficient is applied in the form of studs or wavelets, each stud or wavelet has a unit area of 1 to 30 $mm^2$, and the studs or wavelets are spaced in relation to each other so as to retain the full breathing capacity in the material onto which they are applied, including its permeability to perspiration.

According to another variant embodiment, in the upper part of each cup, at least 20% of the surface of the inner wall has this capacity to adhere to the skin. This particular arrangement allows the downward movement of the breast to be limited to a minimum, by virtue of the non-slip effect of the upper part of the cup which counters this movement.

According to another variant embodiment, in the vertical direction, the assembly constituted by the support elements and the rear panel has an elasticity that is 60% at most. In this case, it is the whole structure of the undergarment, ranging from one side to the other of the contact strip, constituted by the rear panel, the support element, the inner wall of the cups, and the part of the side panel located under the bottom part of the cup, that possesses this elasticity of 60% at most in the vertical direction.

According to another variant embodiment, a side panel extends under a cup as far as the middle panel.

According to another variant embodiment, a side panel or a portion of side panel extends over a lateral part of the cup, with a reduced elasticity in the horizontal direction. The purpose of this arrangement is to limit the external transverse movement of the breast.

According to another variant embodiment, the undergarment includes a linking piece with reduced elasticity, of 15% at most, in the vertical direction, with the said linking piece having two side portions forming the link between the support elements and the contact strip, and a transverse portion connecting the said side portions to the top of the cups so that it is applied against the top of the breast. Because of its reduced vertical elasticity, the transverse portion of this linking piece limits the bounce of the breasts during the practice of sport.

BRIEF DESCRIPTION OF THE DRAWINGS

The present invention will be understood more clearly on reading the description that follows of three examples of embodiment of an undergarment for the practice of sports, illustrated by the appended drawings in which.

DETAILED DESCRIPTION

The undergarment of the present invention is of conventional construction, and the three-dimensional shape of the cups results from its make-up rather than any heat moulding of the material used.

Figure 1:
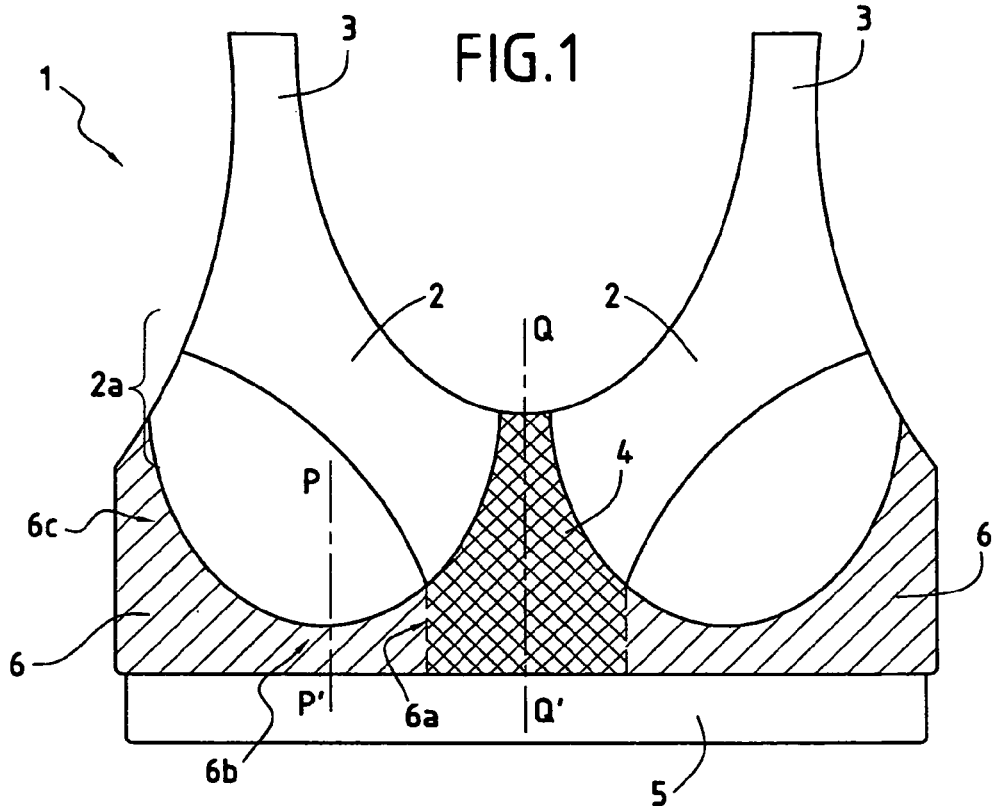
FIG. 1 is a schematic representation seen from the front, only of the front part of a first example of a brassiere.

According to the first exemplary embodiment, the brassiere 1, illustrated in FIG. 1, includes two cups 2, extended upwards by two support elements 3 and separated from each other by a middle panel 4. It also includes an elastic contact strip 5, which is positioned transversally under the cups 2 and under the middle panel 4 and that is intended to tightly hug the bust. In addition, it includes two side panels 6 that extend from the cups 2 to the rear. Each of these side panels 6 extends partially under a cup 2, at least up to two-thirds outside the latter. In the first example illustrated in FIG. 1, each side panel 6 has a front edge 6*a* that lies adjacent to the middle panel 4 and is located substantially equidistant between the central plane PP' of the cup 2 and the middle plane QQ' of the brassiere 1.

The middle panel 4 is elastic both vertically and horizontally, with a horizontal elasticity that is at least 20% and preferably 60% to 80%. It is this horizontal elasticity that allows the relative movement of the breasts in relation to the middle plane QQ' during the opening of the thoracic cage that results from breathing.

In its lower part 6*b*, under the bottom part of the cup, each side panel 6 has an elasticity in the vertical direction that is 60% at most. In part 6*c*, on the outside of the cup 2, each side panel has a reduced horizontal elasticity, of less than 15% for example. The two parts 6*b* and 6*c* can form part of the same side panel 6, as illustrated, or possibly of two separate side panels.

In the case where the front edge 6*a* of the side panel 6 stops at the central plane PP' of the cup 2, then the zone that extends between the said front edge 6*a* and the middle panel 4 can be made from a material that is identical to that used for the inner face of the cup 2. The middle panel 4 can possibly be extended so as to occupy this zone totally.

Regarding the cup 2, it has a three-dimensional configuration that is achieved through the assembly, during the making-up process, of two panels of suitable configuration, along an assembly line. In the figures, the assembly line extends from the bottom inside edge of the cup up to the top outside edge. This is in no way limiting of course. In the vertical direction, its inner wall possesses an elasticity that is 60% at most. In addition, at least 15% of the total area of the said wall has an ability to adhere to the skin, being endowed with wavelets of silicone, each with a dimension of the order of 24 $mm^2$. The distance between each wavelet is the order of a few millimeters, so as not to significantly reduce the breathing capacity of the said material. The distribution of the wavelets can be an even distribution over the whole inner wall of the cup 2. It can also be a varied distribution, in particular in order to favor the upper part 2*a* of the cup 2 in relation to the lower part. The purpose of this is avoid stretching the skin located above the breast, this stretching naturally tending to occur because of the weight of the latter, and which is further amplified during the vertical movements of the breast during the practice of sports.

The adherence capacity of the material constituting the inner wall of the cup can be achieved by means other than studs or wavelets of silicone. It can consist of textile threads based on silicone or elastomer, or indeed a coating of silicone or elastomer, incorporated during the manufacture of the fabric panel constituting the inner wall of the cup. Naturally, any material having a high friction coefficient with the skin and providing an adherence capacity equivalent to that of silicone may be suitable in the context of the present invention.

Figure 2:
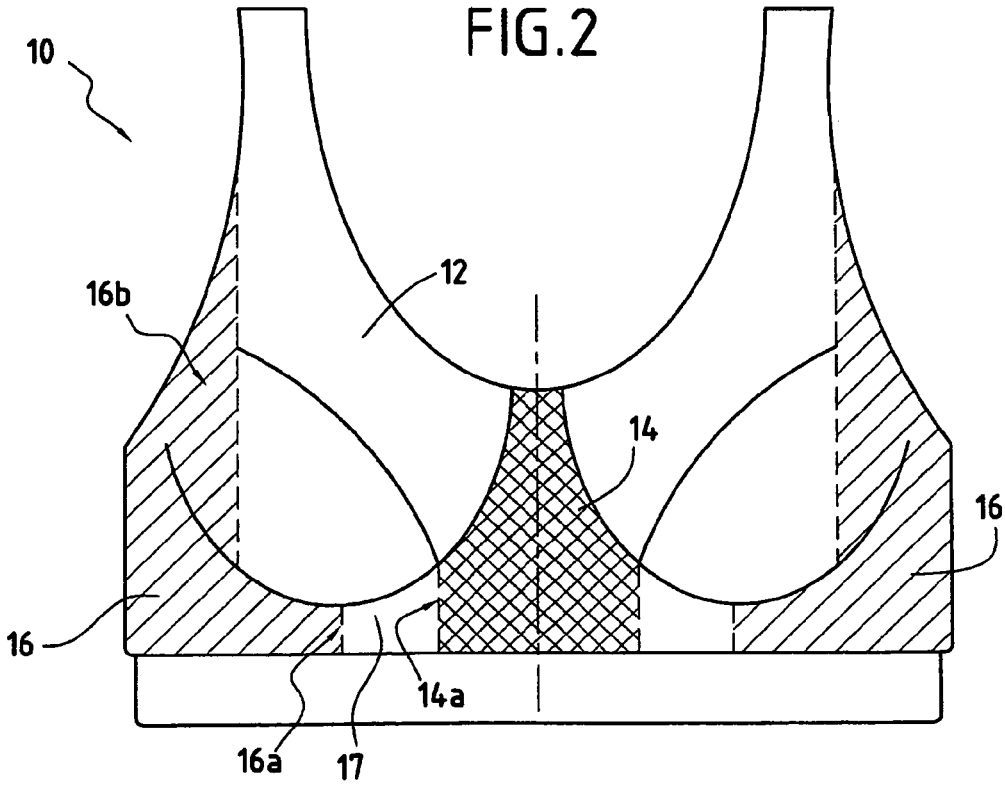
FIG. 2 is a schematic representation seen from the front of the front part of a second example.

In the second example illustrated in FIG. 2, the brassiere 10 differs from that of the first example by the following points.

The front edge 16*a* of the side panel 16 stops at the central plane PP' of the cup 12. The zone 17 that extends between this front edge 16*a* and the adjacent edge 14*a* of the middle panel 14 is made from a textile material that is compatible with that of the inner wall of the cup 12.

The side panel 16 includes an extension 16*b* that covers the cup 12 laterally, which has the effect of enhancing the vertical and horizontal stiffness of the structure of the brassiere 10.

Figure 3:
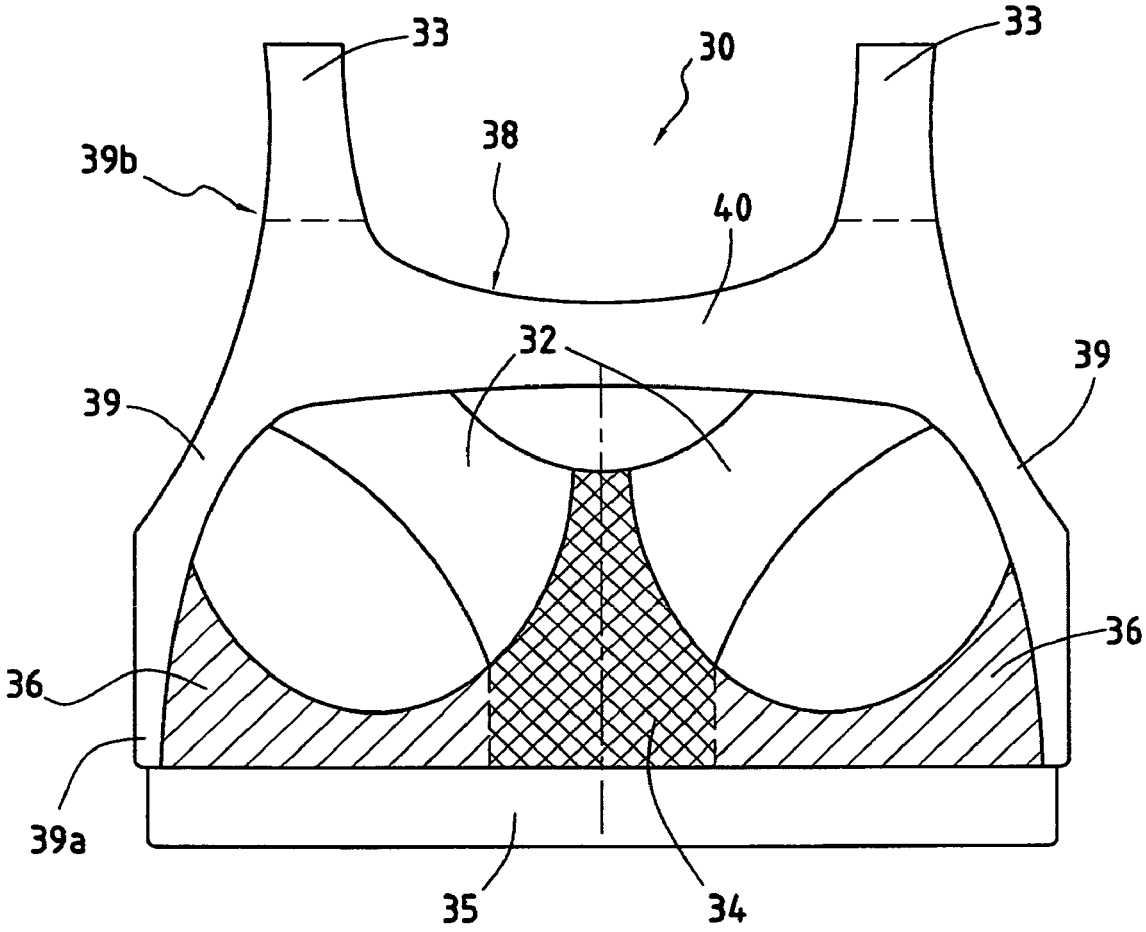
FIG. 3 is a schematic representation, seen from the front, of the front part of a third example.

The third exemplary embodiment, illustrated in FIG. 3, includes the same constituents as the brassiere 1 of the first example, with the two cups 32, the middle panel 34, the support elements 33, the two side panels 36 and the contact strip 35. All these constituents have the same characteristics as those that have been described above in the context of the first example of a brassiere 1. The undergarment 30 also includes a connecting piece 38. This piece 38 has a reduced elasticity in the vertical direction that is less than 40%. On the other hand, its elasticity in the horizontal direction can be of the same order as that of the side panels 36.

The linking piece 38 has two side portions 39. Each of these side portions 39 is connected to the contact strip 35 by its lower end 39*a* and to a support element 33 by its upper end 39*b*. The two side portions 39 of this linking piece 38 are attached to each other by a transverse portion 40 that extends above the two cups 32, so that when the undergarment 30 is worn by the user, this transverse portion 40 presses onto the top of the breast. In particular because of the reduced vertical elasticity of its transverse portion 40, this linking piece 38 limits the bounce of the breasts during the practice of sports.

There was mention in the above description of the inner wall of the cup. In practice the cup can be formed from a single textile layer that constitutes this inner wall. However the cup can also include an outer wall lying above the inner wall and being assembled to the latter during its make-up along the same assembly lines, by stitching in particular, with the other panels, namely the middle panel and the side panel. In this case, the outer wall preferably has an area whose dimensions are less than that of the inner wall and has an elasticity that is greater than the elasticity of the inner wall. When the breast is placed inside the cup, it occupies the volume formed by the inner wall, which has the effect of pushing against the outer wall, since the latter is forming a smaller volume. The outer wall is then put into extension and, by reaction, exerts a certain uniform compression force onto the inner wall and therefore onto the breast. This compression contributes to pressing the inner wall against the breast and to increasing the adherence capacity of the said wall to the skin.

The elasticity values given in the present document for the textile panels are measured on the basis of the international ASTM D 2594 standard.

The invention claimed is:

1. A brassiere, comprising:

two cups for the breasts, the cups each having inner and outer layers;

a contact strip positioned under the cups such that the contact strip encircles at least an area under the bust;

two shoulder straps connected to, and extending upwardly from, the cups, and secondly connected to a rear panel, a middle panel positioned between the two cups, and side panels extending from the cups to the rear panel, wherein:

a) the inner layers of the cups having a vertical elasticity of at least 60% with respect to a total vertical height of the cups, and at least 15% of the total area of the inner layers configured to contact the skin, and b) the middle panel has a horizontal elasticity of at least 20% of the entire panel.

2. A brassiere according to claim 1, wherein an adherence capability of the inner layers of the cups is increased due to the presence of a silicone material that has a high friction coefficient with skin.

3. A brassiere according to claim 2, wherein the silicone material comes in the form of studs or wavelets deposited onto a panel from which the inner layers of the cup are formed.

4. A brassiere according to claim 3, wherein each stud or wavelet has a unit area of 1 to 30 $mm^2$.

5. A brassiere according to claim 1, wherein each side panel extends partially under at least a bottom portion, as well as the inner and outer layers, of one of the respective cups, along at least two-thirds of an outside of each of said respective cups, and each side panel has a vertical elasticity of not more than 60% in the part of each side panel that extends under the at least bottom portion of the cup.

6. A brassiere according to claim 1, wherein a side panel extends under at least a portion of each respective cup up to the middle panel.

7. A brassiere according to claim 1, wherein a side panel or a portion of a side panel extends on at least a portion of an outside of the cup, with a reduced elasticity in the horizontal direction.

8. A brassiere according to claim 1, including a linking piece with a vertical elasticity of not more than 40%, the linking piece having two side portions forming the link between the shoulder straps and the contact strip and a transverse portion connecting the side portions above the cups.

9. A brassiere according to claim 1, wherein the middle panel has a horizontal elasticity of 60% to 80%.

10. A brassiere according to claim 2, wherein the silicone material is a continuous coating deposited onto a panel from which the inner layer of the cup is formed.

11. A brassiere according to claim 2, wherein the silicone material is threads inserted during the manufacture of a panel from which the inner layer of the cup is formed.

* * * * *